US009691577B2

(12) United States Patent
Lee

(10) Patent No.: US 9,691,577 B2
(45) Date of Patent: Jun. 27, 2017

(54) RELAY

(71) Applicant: LSIS CO., LTD., Anyang-si, Gyeonggi-do (KR)

(72) Inventor: Su Jung Lee, Cheongju-si (KR)

(73) Assignee: LSIS CO., LTD., Anyang-si (KR)

( * ) Notice: Subject to any disclaimer, the term of this patent is extended or adjusted under 35 U.S.C. 154(b) by 0 days.

(21) Appl. No.: 14/709,335

(22) Filed: May 11, 2015

(65) Prior Publication Data

US 2016/0012991 A1 Jan. 14, 2016

(30) Foreign Application Priority Data

Jul. 11, 2014 (KR) ..... 20-2014-0005232 U

(51) Int. Cl.
*H01H 9/44* (2006.01)
*H01H 45/00* (2006.01)
*H01H 50/54* (2006.01)

(52) U.S. Cl.
CPC ..... *H01H 45/00* (2013.01); *H01H 9/443* (2013.01); *H01H 50/546* (2013.01)

(58) Field of Classification Search
CPC ..... H01H 50/38; H01H 50/443; H01H 50/546
See application file for complete search history.

(56) References Cited

U.S. PATENT DOCUMENTS

2011/0241809 A1* 10/2011 Sugisawa ..... H01H 1/54 335/188

FOREIGN PATENT DOCUMENTS

| | | |
|---|---|---|
| CN | 102456510 | 5/2012 |
| CN | 202487498 | 10/2012 |
| CN | 103155083 | 6/2013 |
| CN | 103187210 | 7/2013 |
| EP | 2372735 | 10/2011 |
| JP | 2010267470 | 11/2010 |
| JP | 2011-204473 | 10/2011 |
| JP | 2011204480 | 10/2011 |
| JP | 2012104366 | 5/2012 |
| JP | 2012256482 | 12/2012 |
| JP | 2013041815 | 2/2013 |

OTHER PUBLICATIONS

European Patent Office Application Serial No. 15171150.4, Search Report dated Dec. 22, 2015, 9 pages.
Japan Patent Office Application Serial No. 2015-134239, Office Action dated May 10, 2016, 3 pages.
State Intellectual Property Office of the People's Republic of China Application Serial No. 201510363833.9, Office Action dated Feb. 4, 2017, 13 pages.
Japan Patent Office Application No. 2015-134239, Notice of Allowance dated Feb. 7, 2017, 4 pages.

* cited by examiner

*Primary Examiner* — Ramon M Barrera
(74) *Attorney, Agent, or Firm* — Lee, Hong, Degerman, Kang & Waimey

(57) ABSTRACT

Disclosed is a relay. The relay includes a first fixed contact, a second fixed, a movable contact, and a first magnet and a second magnet. The first contact part is disposed at a position which is closer to a distance to the second magnet than a distance to the first magnet, and the second contact part is disposed at a position which is closer to the distance to the first magnet than the distance to the second magnet. Accordingly, arcs are prevented from gathering at one position, and a contacting force between the movable contact and the fixed contacts is prevented from being reduced.

7 Claims, 18 Drawing Sheets

RELAY

CROSS-REFERENCE TO RELATED APPLICATIONS

Pursuant to 35 U.S.C. §119(a), this application claims the benefit of earlier filing date and right of priority to Korean Patent Application No. 20-2014-0005232, filed on Jul. 11, 2014, the contents of which are all hereby incorporated by reference herein in its entirety.

BACKGROUND OF THE DISCLOSURE

1. Field of the Disclosure

The present disclosure relates to a relay, and particularly, to a relay which includes a magnet and extinguishes an arc.

2. Background of the Disclosure

Generally, an electronic switching device is a type of electrical contact switching device and may be applied to vehicles, various industrial equipment, machines, etc.

FIG. 1 is a cross-sectional view illustrating a whole structure of a relay. FIG. 2 is a perspective view illustrating a switching unit of a related art relay. FIG. 3 is a plan view illustrating an extinguishment direction of an arc when the relay of FIG. 2 is discharged. FIG. 4 is a plan view illustrating an extinguishment direction of an arc when the relay of FIG. 2 is charged.

As illustrated in FIGS. 1 to 4, the related art relay includes a switching unit S, which switches a circuit, and a driver D that drives the switching unit S.

The switching unit S includes a first fixed contact 10, a second fixed contact 20, a movable contact 30 that electrically connects the first fixed contact 10 to the second fixed contact 20 (hereafter referred to as fixed contacts) or detached the first fixed contact 10 from the second fixed contact 20, and a first magnet 40 and a second magnet 50 (hereinafter referred to as magnets) that respectively include opposite polar surfaces 42 and 52 facing each other with a first contact part C1 and a second contact part C2 (hereinafter referred to as contact parts) therebetween. Here, the movable contact 30 contacts the first fixed contact 10 or is detached from the first fixed contact 10 with respect to the first contact part C1, and the movable contact 30 contacts the second fixed contact 20 or is detached from the second fixed contact 20 with respect to the second contact part C2.

The driver D, for example, is configured with an actuator that generates a driving force with electrical power.

Hereinafter, effects of the related art relay will be described.

When power is applied to the driver D, the movable contact 30 is moved, by the driver D, in a direction (an up direction in FIG. 2) contacting the fixed contacts 10 and 20 and contacts the fixed contacts 10 and 20. When the movable contact 30 contacts the fixed contacts 10 and 20, the circuit is electrically connected to the movable contact 30. When the circuit is connected to the movable contact 30, a current may flow from the first fixed contact 10 to the second fixed contact 20 through the movable contact 30, or flow from the second fixed contact 20 to the first fixed contact 10 through the movable contact 30. For example, in a vehicle, the first fixed contact 10 may be connected to an electricity storage such as a battery of the vehicle, and the second fixed contact 20 may be connected to an apparatus (hereinafter referred to as an electricity consumption-generation apparatus) which consumes and generates electricity like a driver of the vehicle. In this case, when electricity is discharged (hereinafter referred to as discharging of the electricity storage) from the electricity storage to the electricity consumption-generation apparatus, a current applied from the electricity storage to the first fixed contact 10 may be supplied to the electricity consumption-generation apparatus through the movable contact 30 and the second fixed contact 20. On the other hand, when electricity is charged (hereinafter referred to as charging of the electricity storage) from the electricity consumption-generation apparatus into the electricity storage, a current applied from the electricity consumption-generation apparatus to the second fixed contact 20 may be supplied to the electricity storage through the movable contact 30 and the first fixed contact 10.

When the supply of power to the driver D is stopped, the movable contact 30 is moved, by the driver D, in a direction (a down direction in FIG. 2) deviating from the fixed contacts 10 and 20 and is detached from the fixed contacts 10 and 20. When the movable contact 30 is detached from the fixed contacts 10 and 20, the circuit is broken.

In such a process, when the movable contact 30 contacts the fixed contacts 10 and 20 and is detached from the fixed contacts 10 and 20, arcs respectively occur in the contact parts C1 and C2.

As illustrated in FIGS. 3 and 4, the respective arcs occurring in the contact parts C1 and C2 are extinguished by the magnets 40 and 50.

In more detail, the contact parts C1 and C2 are provided within a range of an electric field (an electric field flowing in a down direction in the drawing) which flows from the first magnet 40 to the second magnet 50.

Moreover, when an electricity storage illustrated in FIG. 3 is discharged, a current $I_{C1}$ at the first contact part C1 flows from the first fixed contact 10 to the movable contact 30 (a direction entering into the paper in the drawing). Also, a current $I_{30}$ at the movable contact 30 flows from the first contact part C1 to the second contact part C2 (a right direction in the drawing). Also, a current $I_{C2}$ at the second contact part C2 flows from the movable contact 30 to the second fixed contact 20 (a direction out from the paper in the drawing). Therefore, the arc occurring in the first contact part C1 receives a force F11 in a direction (a left direction in the drawing) based on the Fleming's left hand rule and is moved in an outer direction (the left direction in the drawing) of the first contact part C1. Also, the arc occurring in the second contact part C2 receives a force F21 in a direction (a right direction in the drawing) based on the Fleming's left hand rule and is moved in an outer direction (the right direction in the drawing) of the second contact part C2. The arcs which are respectively moved in the outer directions of the contact parts C1 and C2 are cooled by, for example, an extinguishing material such as air and are extinguished.

On the other hand, when an electricity storage illustrated in FIG. 4 is charged, a current $I_{C2}'$ at the second contact part C2 flows from the second fixed contact 20 to the movable contact 30 (a direction entering into the paper in the drawing). Also, a current $I_{30}'$ at the movable contact 30 flows from the second contact part C2 to the first contact part C1 (the left direction in the drawing). Also, a current $I_{C1}'$ at the first contact part C1 flows from the movable contact 30 to the first fixed contact 10 (a direction out from the paper in the drawing). Therefore, the arc occurring in the first contact part C1 receives a force F11' in a direction (the right direction in the drawing) based on the Fleming's left hand rule and is moved in an inner direction (the right direction in the drawing) of the first contact part C1. Also, the arc occurring in the second contact part C2 receives a force F21' in a direction (the left direction in the drawing) based on the Fleming's left hand rule and is moved in an inner direction (the left direction in the drawing) of the second contact part C2. The arcs which are respectively moved in the inner directions of the contact parts C1 and C2 are cooled by, for example, an extinguishing material such as air and are extinguished.

However, in the related art relay, the contact parts C1 and C2 are disposed on a virtual plane which perpendicularly intersects the polar surface 42 of the first magnet 40 and the polar surface 52 of the second magnet 50 (hereinafter referred to as polar surfaces) which face each other. Also, the first contact part C1 is disposed at a position where a distance to the first magnet 40 is the same as a distance to the second magnet 50, and the second contact part C2 is disposed at a position where the distance to the first magnet 40 is the same as the distance to the second magnet 50. In other words, the magnets 40 and 50 are disposed in order for the polar surfaces 42 and 52 to be parallel to a virtual axis A which connects the contact parts C1 and C2. Therefore, the arcs which respectively occur in the contact parts C1 and C2 are moved along the virtual axis A, and when the electricity storage illustrated in FIG. 4 is charged, the arcs gather at centers (a center of the movable contact 30) of the contact parts C1 and C2. Therefore, excessive heat is generated in the centers (the center of the movable contact 30) of the contact parts C1 and C2, and for this reason, the switching unit S (in more detail, the movable contact 30) is damaged.

In the related art relay, the current $I_{30}$ ($I_{30}'$) flowing in the movable contact 30 flows in parallel with the polar surfaces 42 and 52 of the magnets 40 and 50. Therefore, a force based on the Fleming's left hand rule is applied to the movable contact 30 by the current $I_{30}$ ($I_{30}'$) flowing in the movable contact 30 and a magnetic field B of each of the magnets 40 and 50, and when the electricity storage illustrated in FIG. 3 is discharged, the force is applied in a direction (a direction entering into the paper in the drawing) where the movable contact 30 is detached from the fixed contacts 10 and 20. Therefore, a contacting force between the movable contact 30 and the fixed contacts 10 and 20 is reduced.

SUMMARY OF THE DISCLOSURE

Therefore, an aspect of the detailed description is to provide a relay which can prevent arcs, which respectively occurs in a plurality of contact parts, from gathering at one position even when a current flows in any direction.

Another aspect of the detailed description is to provide a relay which can prevent a contacting force between a movable contact and a plurality of fixed contacts from being reduced by a force based on the Fleming's left hand rule.

To achieve these and other advantages and in accordance with the purpose of this specification, as embodied and broadly described herein, a relay includes: a first fixed contact; a second fixed contact separated from the first fixed contact; a movable contact configured to connect the first fixed contact to the second fixed contact and detach the first fixed contact from the second fixed contact; and a first magnet and a second magnet configured to respectively include opposite polar surfaces facing each other in parallel with a first contact part and a second contact part therebetween, wherein the movable contact contacts the first fixed contact and is detached from the first fixed contact with respect to the first contact part, and the movable contact contacts the second fixed contact and is detached from the second fixed contact with respect to the second contact part.

The first contact part may be disposed at a position which is closer to a distance to the second magnet than a distance to the first magnet, and the second contact part may be disposed at a position which is closer to the distance to the first magnet than the distance to the second magnet.

The first magnet and the second magnet may be disposed not to be parallel to a virtual axis which connects the first contact part to the second contact part.

The first contact part may be disposed close to the second magnet within a range where the first contact part does not contact the second magnet, and the second contact part may be disposed close to the first magnet within a range where the second contact part does not contact the first magnet.

The first contact part and the second contact part may be disposed on a virtual plane which perpendicularly intersects the polar surfaces.

The movable contact may include: a center long provided in one direction; a first contact end bent from one end of the center and configured to detachably contact the first fixed contact; and a second contact end bent in a direction opposite to a bending direction of the first contact end from the other end of the center and configured to detachably contact of the second fixed contact.

The first contact end and the second contact end may be bent to be vertical to the center.

In the movable contact, the first fixed contact may contact the second fixed contact in a state where an extension direction of the center is vertical to the polar surfaces, an extension direction of the first contact end may be parallel to the polar surfaces, and an extension direction of the second contact end may be parallel to the polar surfaces, on the virtual plane.

The movable contact may be long provided in one direction, the movable contact may contact the first fixed contact and is detached from the first fixed contact at one end of the movable contact, and the movable contact may contact the second fixed contact and is detached from the second fixed contact at the other end of the movable contact.

The movable contact may be long provided in a straight-line direction, and the movable contact may contact the first fixed contact and the second fixed contact in a state of being inclined with respect to the polar surfaces on the virtual plane.

The movable contact may be long provided in a straight-line direction, and the movable contact may contact the first fixed contact and the second fixed contact in a state where an extension direction of the movable contact is vertical to the polar surfaces on the virtual plane.

Further scope of applicability of the present application will become more apparent from the detailed description given hereinafter. However, it should be understood that the detailed description and specific examples, while indicating preferred embodiments of the disclosure, are given by way of illustration only, since various changes and modifications within the spirit and scope of the disclosure will become apparent to those skilled in the art from the detailed description.

BRIEF DESCRIPTION OF THE DRAWINGS

The accompanying drawings, which are included to provide a further understanding of the disclosure and are incorporated in and constitute a part of this specification, illustrate exemplary embodiments and together with the description serve to explain the principles of the disclosure.

In the drawings.

DETAILED DESCRIPTION OF THE DISCLOSURE

Description will now be given in detail of the exemplary embodiments, with reference to the accompanying drawings. For the sake of brief description with reference to the drawings, the same or equivalent components will be provided with the same reference numbers, and description thereof will not be repeated.

Hereinafter, exemplary embodiments of the present invention will be described in detail with reference to the accompanying drawings.

In this disclosure below, a direction (a direction entering into the paper in FIG. 1) vertical to a plurality of polar surfaces 142 and 152 to be described below is referred to as a width direction, a direction (a horizontal direction in FIG. 1) parallel to the polar surfaces 142 and 152 on a virtual plane to be described below is referred to as a length direction, and a direction (a vertical direction in FIG. 1) vertical to both the width direction and the length direction is referred to as a depth direction.

Figure 1:
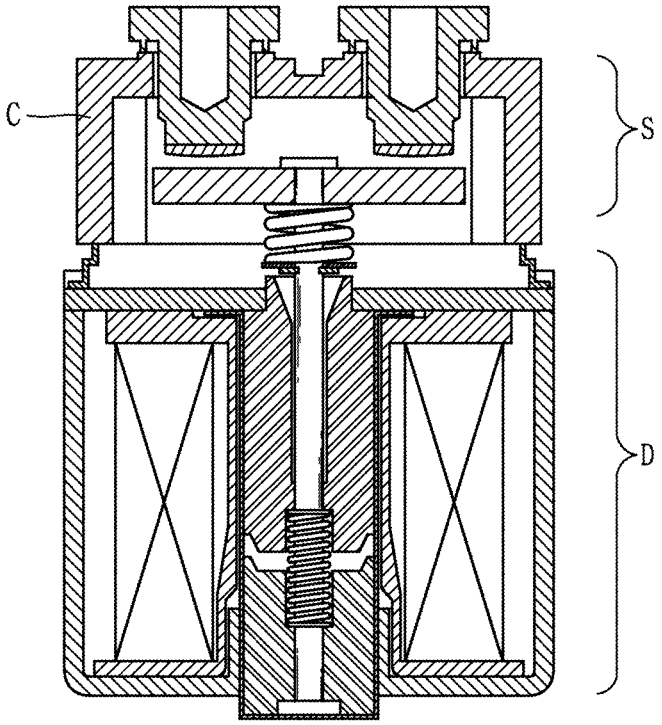
FIG. 1 RELATED ART
FIG. 1 is a cross-sectional view illustrating a whole structure of a relay.
Figure 2:
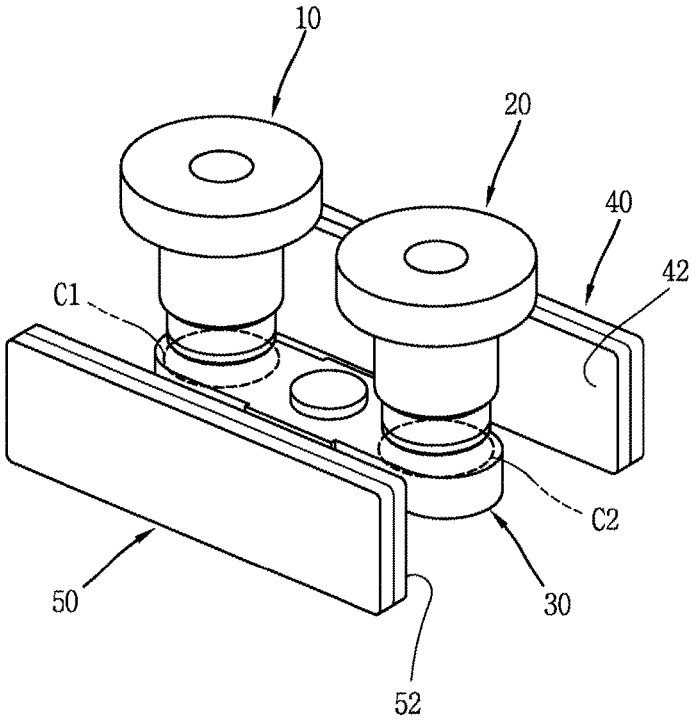
FIG. 2 RELATED ART
FIG. 2 is a perspective view illustrating a switching unit of a related art relay.
Figure 3:
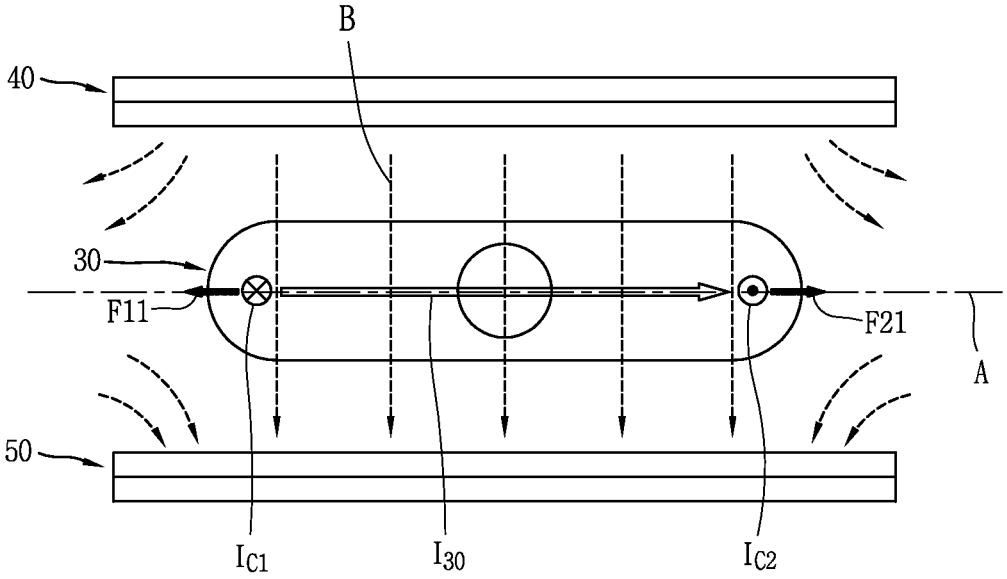
FIG. 3 RELATED ART
FIG. 3 is a plan view illustrating an extinguishment direction of an arc when the relay of FIG. 2 is discharged.
Figure 4:
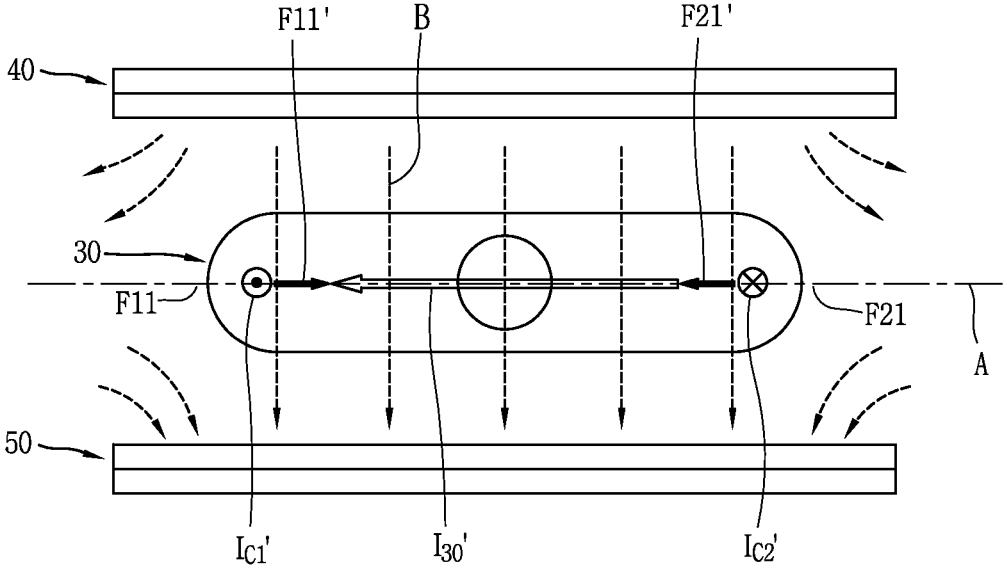
FIG. 4 RELATED ART
FIG. 4 is a plan view illustrating an extinguishment direction of an arc when the relay of FIG. 2 is charged.
Figure 5:
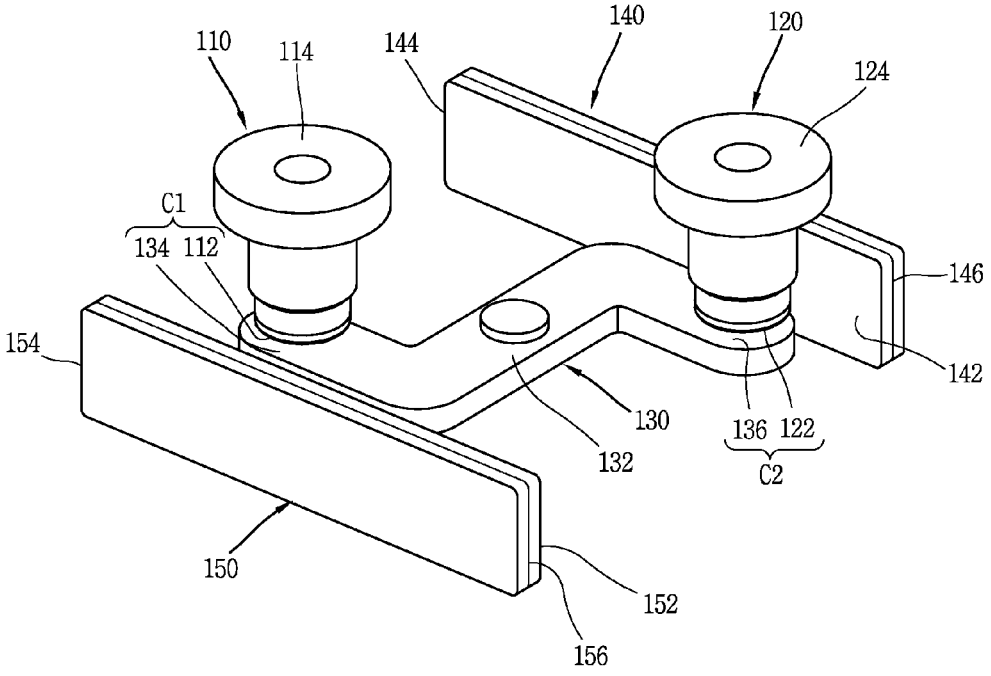
FIG. 5 is a perspective view illustrating a switching unit of a relay according to an exemplary embodiment of the present invention.
Figure 6:
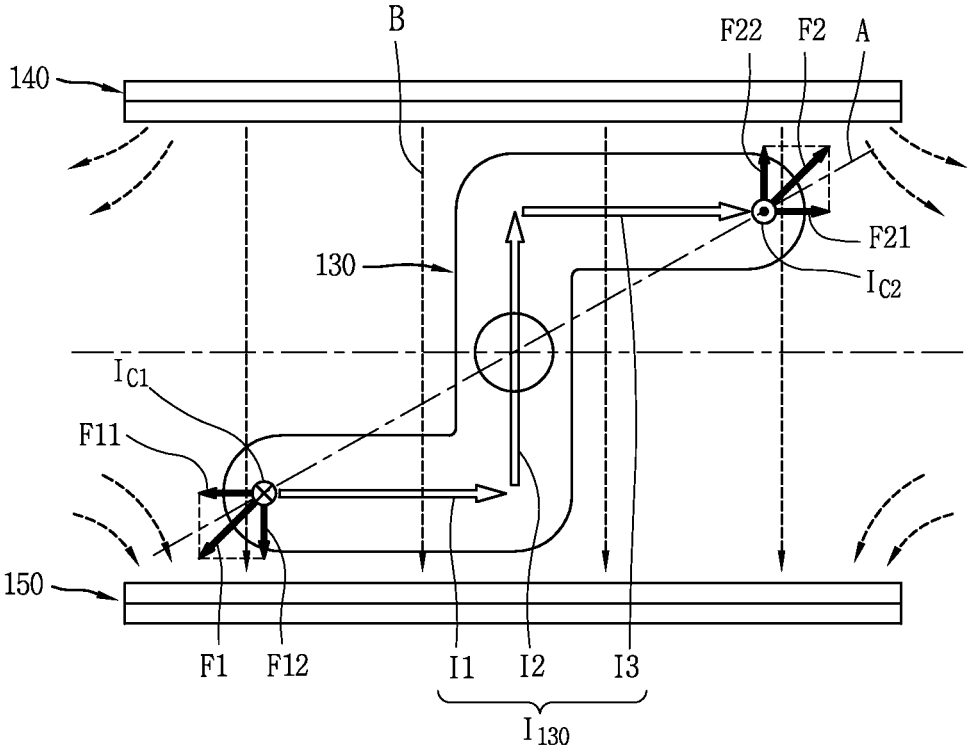
FIG. 6 is a plan view illustrating an extinguishment direction of an arc when the relay of FIG. 5 is discharged.
Figure 7:
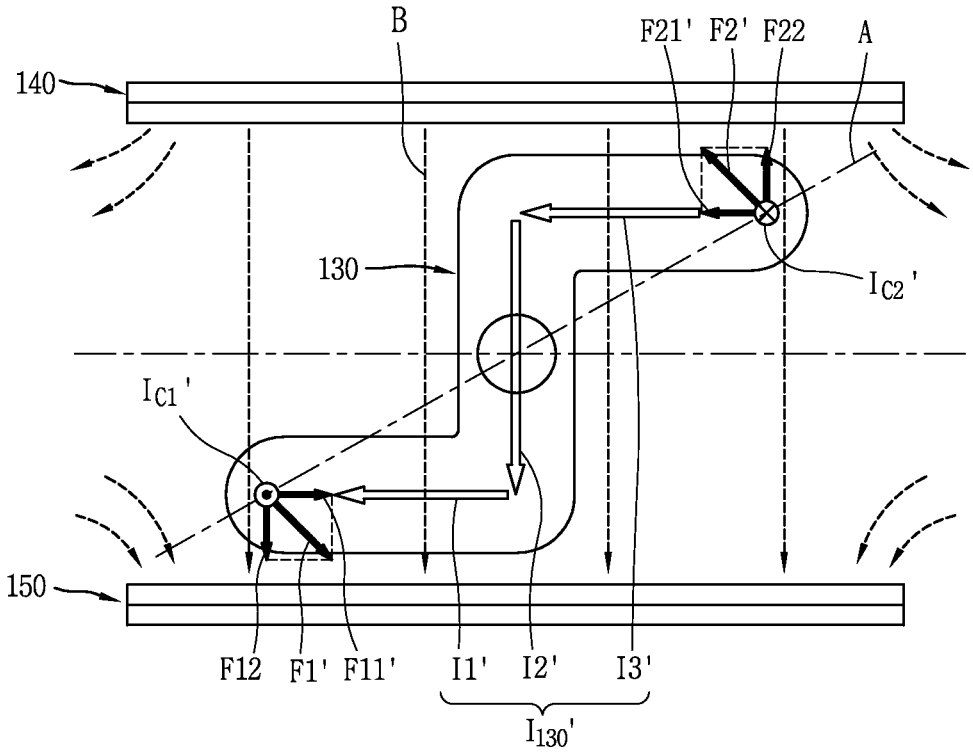
FIG. 7 is a plan view illustrating an extinguishment direction of an arc when the relay of FIG. 5 is charged.

FIG. 1 is a cross-sectional view illustrating a whole structure of a relay. FIG. 5 is a perspective view illustrating a switching unit of a relay according to an exemplary embodiment of the present invention. FIG. 6 is a plan view illustrating an extinguishment direction of an arc when the relay of FIG. 5 is discharged. FIG. 7 is a plan view illustrating an extinguishment direction of an arc when the relay of FIG. 5 is charged.

As illustrated in the drawings, the relay according to an exemplary embodiment of the present invention includes a switching unit S, which switches a circuit, and a driver D that drives the switching unit S.

The switching unit S may include a first fixed contact 110, a second fixed contact 120 which is separated from the first fixed contact 110, and a movable contact 130 that electrically connects the first fixed contact 110 to the second fixed contact 120 (hereafter referred to as fixed contacts) or detaches the first fixed contact 110 from the second fixed contact 20. Also, the switching unit S may further include a first magnet 140 and a second magnet 150 (hereinafter referred to as magnets) that respectively include opposite polar surfaces 142 and 152 facing each other in parallel with a first contact part C1 and a second contact part C2 (hereinafter referred to as contact parts) therebetween. Here, the movable contact 130 may contact the first fixed contact 110 or may be detached from the first fixed contact 110 with respect to the first contact part C1, and the movable contact 130 may contact the second fixed contact 120 or may be detached from the second fixed contact 120 with respect to the second contact part C2. Also, the fixed contacts 110 and 120, the movable contact 130, and the contact parts C1 and C2 may be provided in an external box C of the relay, and the magnets 140 and 150 may be provided outside the external box C.

The first contact part C1 may be disposed at a position which is closer to a distance to the second magnet 150 than a distance to the first magnet 140. Also, the second contact part C2 may be disposed at a position which is closer to the distance to the first magnet 140 than the distance to the second magnet 150. In other words, the polar surfaces 142 and 152 (the polar surface 142 of the first magnet 140 and the polar surface 152 of the second magnet 150 which face each other) of the magnets 140 and 150 may be disposed not to be parallel to a virtual axis A which connects the contact parts C1 and C2. In the present embodiment, the magnets 140 and 150 may be disposed in order for the polar surfaces 142 and 152 to be inclined with respect to the virtual axis A.

Moreover, as described below, in order to more effectively prevent arcs from gathering at one position when an electricity storage is charged, the first contact part C1 may be disposed close to the second magnet 150 within a range where the first contact part C1 does not contact the second magnet 150, and the second contact part C2 may be disposed close to the first magnet 140 within a range where the second contact part C2 does not contact the first magnet 140.

To this end, the fixed contacts 110 and 120, the movable contact 130, and the magnets 140 and 150 may be provided as follows.

That is, the fixed contacts 110 and 120 may be fixed to and supported by the external box C. The fixed contacts 110 and 120 may be electrically connected to an external element (for example, an electricity storage such as a battery of a vehicle or an apparatus (hereinafter referred to as an electricity consumption-generation apparatus) which consumes and generates electricity like a driver of the vehicle) of the relay at one side of each of the fixed magnets 110 and 120, and the fixed contacts 110 and 120 may contact the movable contact 130 and may be detached from the movable contact 130 at the other side.

In more detail, the first fixed contact 110 may be approximately cylindrical in shape and may be fixed to and supported by the external box C. In this case, an axial direction of the first fixed contact 110 may be disposed in parallel with the polar surfaces 142 and 152, one end 112 of the first fixed contact 110 may be disposed in the external box C, and the other end 114 may protrude to outside the external box C. The one end 112 of the first fixed contact 110 may be disposed on a virtual plane which perpendicularly intersects the polar surfaces 142 and 152. The one end 112 of the first fixed contact 110 may contact a below-described first contact end 134 of the movable contact 130 and may be detached from the first contact end 134. The other end 114 of the first fixed contact 110 may be electrically connected to the electricity storage.

The second fixed contact 120 may be approximately cylindrical in shape and may be fixed to and supported by the external box C. In this case, an axial direction of the second fixed contact 120 may be disposed in parallel with the axial direction of the first fixed contact 110, one end 122 of the second fixed contact 120 may be disposed in the external box C, and the other end 124 may protrude to outside the external box C. The one end 122 of the second fixed contact 120 may be disposed on the virtual plane. The one end 122 of the second fixed contact 120 may contact a below-described second contact end 136 of the movable contact 130 and may be detached from the second contact end 136. The other end 124 of the second fixed contact 120 may be electrically connected to the electricity consumption-generation apparatus.

Here, the fixed contacts 110 and 120 may be provided in order for the one ends 112 and 122 of the fixed contacts 110 and 120 to be separated from each other in a width direction (a vertical direction in FIG. 6) and a length direction (a horizontal direction in FIG. 6). In other words, the fixed contacts 110 and 120 may be provided so that the one ends 112 and 122 of the fixed contacts 110 and 120 are separated from each other and the virtual axis A which connects the one ends 112 and 122 of the fixed contacts 110 and 120 is inclined with respect to the polar surfaces 142 and 152 on the virtual plane. To this end, the first fixed contact 110 may be provided in order for the one end 112 of the first fixed contact 110 to be disposed at a position, which is closer to the distance to the second magnet 150 than the distance to the first magnet 140, on the virtual plane. Also, the second fixed contact 120 may be provided so that the one end 122 of the second fixed contact 120 is separated from the one end 112 of the first fixed contact 110 in the length direction (the horizontal direction in FIG. 6) on the virtual plane and the one end 122 of the second fixed contact 120 is disposed at a position, which is closer to the distance to the first magnet 140 than the distance to the second magnet 150, on the virtual plane. In this case, as described below, in order to more effectively prevent arcs from gathering at one position when the electricity storage is charged, the first fixed contact 110 may be disposed close to the second magnet 150 within a range where the one end 112 of the first fixed contact 110 does not contact the second magnet 150, and the second fixed contact 120 may be disposed close to the first magnet 140 within a range where the one end 122 of the second fixed contact 120 does not contact the first magnet 140.

The movable contact 130 may include: a center 132 which is long provided in one direction; the first contact end 134 which is vertically bent from one end of the center 132, contacts the one end 112 of the first fixed contact 110, and is detached from the one end 112 of the first fixed contact 110; and the second contact end 136 which is bent in a direction opposite to a bending direction of the first contact end 134 from the other end of the center 132, contacts the one end 122 of the second fixed contact 120, and is detached from the one end 122 of the second fixed contact 120. Here, the first contact end 134 and the one end 112 of the first fixed contact 110 may configure the first contact part C1, and the second contact end 136 and the one end 122 of the second fixed contact 120 may configure the second contact part C2.

Moreover, in the movable contact 130, a width of the center 132 may be provided to correspond to a separation distance of the fixed contacts 110 and 120 in the width direction (the vertical direction in FIG. 6), a length of the first contact end 134 may be provided greater than a length from the center 132 to the one end 112 of the first fixed contact 110, and a length of the second contact end 136 may be provided greater than a length from the center 132 to the one end 122 of the second fixed contact 120, with respect to a case where the movable contact 130 contact the fixed contacts 110 and 120.

The movable contact 130 having the above-described structure may be provided so that an extension direction of the center 132 is vertical to the polar surfaces 142 and 152 on the virtual plane, an extension direction of the first contact end 134 is parallel to the polar surfaces 142 and 152, and an extension direction of the second contact end 136 is parallel to the polar surfaces 142 and 152, with respect to a case where the movable contact 130 contacts the fixed contacts 110 and 120. Also, as described above, the movable contact 130 may be provided so that the movable contact 130 is parallelly moved in a direction (a vertical direction in FIG. 5) vertical to the virtual plane in a state of contacting the fixed contacts 110 and 120 and is detached from the one ends 112 and 122 of the fixed contacts 110 and 120. That is, the movable contact 130 may be provided so that the movable contact 130 is moved in a direction vertical to the virtual plane, contacts the one ends 112 and 122 of the fixed contacts 110 and 120, and is detached from the one ends 112 and 122 of the fixed contacts 110 and 120, in a state the center 132 is vertical to the polar surfaces 142 and 152, the contact ends 134 and 136 respectively face the one ends 112 and 122 of the fixed contacts 110 and 120, and the contact ends 134 and 136 are parallel to the respective polar surfaces 142 and 152.

The first magnet 140 may be provided in a plate shape having a certain length and depth for applying a magnetic field to the contact parts C1 and C2.

A length of the first magnet 140 may be provided greater than a length-direction separation distance of the contact parts C1 and C2 so as to accommodate the contact parts C1 and C2 in a length direction thereof. As described below, a length of the first magnet 140 may be longer than the length-direction separation distance of the contact parts C1 and C2 and may be a length which enables one end 144 and the other end 146 of the first magnet 140 to reach an inner wall of the external box C, so that even when an arc which is guided in an outer direction of each of the contact parts C1 and C2 deviates from the contact parts C1 and C2, the arch is continuously affected by an electric field.

A depth of the first magnet 140 may be provided greater than a separation distance between the movable contact 130 and the fixed contacts 110 and 120 so as to accommodate the contact parts C1 and C2 in a depth direction thereof. Here, the separation distance between the movable contact 130 and the fixed contacts 110 and 120 may denote a separation distance between the contact ends 134 and 136 and the one ends 112 and 122 of the fixed contacts 110 and 120 when the movable contact 130 is detached from the fixed contacts 110 and 120.

The second magnet 150 may be symmetrical with the first magnet 140.

The first magnet 140 having the above-described structure may be provided in order for the polar surface 142 having N pole to face the contact parts C1 and C2, and the second magnet 150 may be provided in order for the polar surface 152 having S pole to face the contact parts C1 and C2. Here, the magnets 140 and 150 may be provided in order for the polar surface 142 to be parallel to the polar surface 152. Also, the magnets 140 and 150 may be provided in order for the polar surfaces 142 and 152 to be inclined with respect to the virtual axis A which connects the contact parts C1 and C2.

The magnets 140 and 150 may be separated from the contact parts C1 and C2 by a certain distance and may be disposed outside the external box C, so that a magnetic force is prevented from being weakened because the magnets 140 and 150 are heated by heat generated by an arc or the like.

The driver D may be configured with, for example, an actuator that generates a driving force according to an electrical force generated by a solenoid or the like. The driver D is well known to those of ordinary skill in the art, and thus, its detailed description is not provided.

Hereinafter, effects of the relay according to an exemplary embodiment of the present invention will be described in detail.

When power is applied to the driver D, the movable contact 130 may be moved, by the driver D, in a direction (an up direction in FIG. 5) contacting the fixed contacts 110 and 120 and may contact the fixed contacts 110 and 120. When the movable contact 30 contacts the fixed contacts 110 and 120, the circuit may be electrically connected to the movable contact 130. When the circuit is connected to the movable contact 130, a current may flow from the first fixed contact 110 to the second fixed contact 120 through the movable contact 130, or flow from the second fixed contact 120 to the first fixed contact 110 through the movable contact 130. That is, when the electricity storage is discharged, a current applied from the electricity storage to the first fixed contact 110 may be supplied to the electricity consumption-generation apparatus through the movable contact 130 and the second fixed contact 120. On the other hand, when the electricity storage is charged, a current applied from the electricity consumption-generation apparatus to the second fixed contact 120 may be supplied to the electricity storage through the movable contact 130 and the first fixed contact 110.

When the supply of power to the driver D is stopped, the movable contact 130 may be moved, by the driver D, in a direction (a down direction in FIG. 5) deviating from the fixed contacts 110 and 120 and may be detached from the fixed contacts 110 and 120. When the movable contact 130 is detached from the fixed contacts 110 and 120, the circuit may be broken.

In such a process, when the movable contact 130 contacts the fixed contacts 110 and 120 and is detached from the fixed contacts 110 and 120, arcs respectively occur in the contact parts C1 and C2.

As illustrated in FIGS. 6 and 7, the respective arcs occurring in the contact parts C1 and C2 may be extinguished by the magnets 140 and 150.

First, effects where an arc is extinguished when an electricity storage illustrated in FIG. 6 is discharged will be described in detail.

That is, the contact parts C1 and C2 may be provided within a range of an electric field (an electric field flowing in a down direction in the drawing) which flows from the first magnet 140 to the second magnet 150.

A current $I_{C1}$ at the first contact part C1 may flow from the first fixed contact 110 to the movable contact 130 (in a direction entering into the paper in the drawing).

Moreover, a current $I_{130}$ at the movable contact 130 may flow from the first contact part C1 to the second contact part C2. To provide a more detailed description on a direction of a current at the movable contact 130, a current I1 at the first contact end 134 may flow from the first contact part C1 to a portion connected to the center 132 (in a right direction in the drawing) in parallel with the polar surfaces 142 and 152. A current I2 at the center 132 may flow from a portion connected to the first contact end 134 to a portion connected to the second contact end 136 (in an up direction in the drawing) to be vertical to the polar surfaces 142 and 152. A current I3 at the second contact end 136 may flow from a portion connected to the center 132 to the second contact part C2 (in a right direction in the drawing) in parallel with the polar surfaces 142 and 152.

A current $I_{C2}$ at the second contact part C2 may flow from the movable contact 130 to the second fixed contact 120 (in a direction out from the paper in the drawing).

Due to such an electric field and current, an arc which occurs in the first contact part C1 may receive a force F11 in a direction (a left direction in the drawing) based on the Fleming's left hand rule, and an arc which occurs in the second contact part C2 may receive a force F21 in a direction (a right direction in the drawing) based on the Fleming's left hand rule.

The arc which occurs in the first contact part C1 may receive a force F12 in a direction of the second magnet 150 adjacent thereto, and the arc which occurs in the second contact part C2 may receive a force F22 in a direction (an up direction in the drawing) of the first magnet 140 adjacent thereto. To provide a more detailed description on this, attractive forces of the magnets 140 and 150 may be respectively applied to the arcs. However, when the contact parts C1 and C2 are respectively disposed at centers of the magnets 40 and 50 like the related art, a magnitude of the attractive force of the first magnet 40 is the same as that of the attractive force of the second magnet 50, and a direction of the attractive force of the first magnet 40 is opposite to that of the attractive force of the second magnet 50, whereby the attractive forces of the magnets 140 and 150 are counteracted with each other. In the present embodiment, when one contact part is disposed closer to one magnet than another magnet, a resultant force of attractive forces of the magnets may be applied to a closely disposed magnet. Therefore, in the present embodiment, since the first contact part C1 is disposed closer to the second magnet 150 than the first magnet 140, a resultant force F12 of forces at which the magnets 140 and 150 attract the arc occurring in the first contact part C1 may be applied in a direction (a down direction in the drawing) of the second magnet 150. Also, since the second contact part C2 is disposed closer to the first magnet 140 than the second magnet 150, a resultant force F22 of forces at which the magnets 140 and 150 attract the arc occurring in the second contact part C2 may be applied in a direction (an up direction in the drawing) of the first magnet 140.

The arc which occurs in the first contact part C1 may be moved in a direction (a left and down direction in the drawing), which is inclined from an outer direction (a left direction in the drawing) of the first contact part C1 to the second magnet 150 (a down direction in the drawing), by the resultant forces F1 and F2 of the forces F11 and F21 based on the Fleming's left hand rule and the forces F12 and F22 at which the magnets 140 and 150 attract the arcs, and for example, the arc may be cooled and extinguished by an extinguishing material such as air. Also, the arc which occurs in the second contact part C2 may be moved in a direction (a right and up direction in the drawing) which is inclined from an outer direction (a right direction in the drawing) of the second contact part C2 to the first magnet 140 (an up direction in the drawing), and for example, the arc may be cooled and extinguished by an extinguishing material such as air.

Here, when the electricity storage is discharged, the arcs which respectively occur in the contact parts C1 and C2 may be moved to outside the contact parts C1 and C2 (in a left and down direction and a right and up direction in the drawing), namely, in a direction deviating from each other, and thus may not gather at one position.

In the current $I_{130}$ flowing in the movable contact 130, the current I2 flowing in the center 132 may flow in a direction vertical to the polar surfaces 142 and 152, and thus, a contacting force between the movable contact 130 and the fixed contacts 110 and 120 is prevented from being reduced when the electricity storage is discharged. In more detail, a force based on the Fleming's left hand rule may be applied to the movable contact 130 by the current $I_{130}$ flowing in the movable contact 130 and the magnetic field B of each of the magnets 140 and 150, and when the electricity storage is discharged, the force may be applied in a direction (a direction entering into the paper in FIG. 6) where the movable contact 130 is detached from the fixed contacts 110 and 120. Accordingly, the contacting force between the movable contact 130 and the fixed contacts 110 and 120 is reduced. However, according to the present embodiment, in the current $I_{130}$ flowing in the movable contact 130, the current I2 flowing in the center 132 may flow in a direction vertical to the polar surfaces 142 and 152 and thus may be parallel to a direction of the magnetic field B generated by each of the magnets 140 and 150. Therefore, a magnitude of the force based on the Fleming's left hand rule may become zero at the center 132 due to the current $I_{130}$ flowing in the movable contact 130 and the magnetic field B of each of the magnets 140 and 150. Therefore, a magnitude of a resultant force of forces which are generated based on the Fleming's left hand rule and are applied to an entirety of the movable contact 130 is reduced. Accordingly, when the electricity storage is discharged, the contacting force between the movable contact 130 and the fixed contacts 110 and 120 is prevented from being reduced.

Next, effects where an arc is extinguished when an electricity storage illustrated in FIG. 7 is charged will be described in detail.

That is, the contact parts C1 and C2 may be provided within a range of an electric field (an electric field flowing in a down direction in the drawing) which flows from the first magnet 140 to the second magnet 150.

A current $I_{C2}$' at the second contact part C2 may flow from the second fixed contact 120 to the movable contact 130 (in a direction entering into the paper in the drawing).

Moreover, a current $I_{130}$' at the movable contact 130 may flow from the second contact part C2 to the first contact part C1. To provide a more detailed description on a direction of a current at the movable contact 130, a current I3' at the second contact end 136 may flow from the second contact part C2 to a portion connected to the center 132 (in a left direction in the drawing) in parallel with the polar surfaces 142 and 152. A current I2' at the center 132 may flow from a portion connected to the second contact end 136 to a portion connected to the first contact end 134 (in a down direction in the drawing) to be vertical to the polar surfaces 142 and 152. A current I1' at the first contact end 134 may flow from a portion connected to the center 132 to the first contact part C1 (in a left direction in the drawing) in parallel with the polar surfaces 142 and 152.

A current $I_{C1}$' at the first contact part C1 may flow from the movable contact 130 to the first fixed contact 110 (in a direction out from the paper in the drawing).

Due to such an electric field and current, an arc which occurs in the first contact part C1 may receive a force F11' in a direction (a right direction in the drawing) based on the Fleming's left hand rule, and an arc which occurs in the second contact part C2 may receive a force F21' in a direction (a left direction in the drawing) based on the Fleming's left hand rule.

As described above, the arc which occurs in the first contact part C1 may receive a force F12 in a direction of the second magnet 150 adjacent thereto, and the arc which occurs in the second contact part C2 may receive a force F22 in a direction (an up direction in the drawing) of the first magnet 140 adjacent thereto.

The arc which occurs in the first contact part C1 may be moved in a direction (a right and down direction in the drawing), which is inclined from an inner direction (a right direction in the drawing) of the first contact part C1 to the second magnet 150 (a down direction in the drawing), by the resultant forces F1' and F2' of the forces F11' and F21' based on the Fleming's left hand rule and the forces F12 and F22 at which the magnets 140 and 150 attract the arcs, and for example, the arc may be cooled and extinguished by an extinguishing material such as air. Also, the arc which occurs in the second contact part C2 may be moved in a direction (a left and up direction in the drawing) which is inclined from an inner direction (a left direction in the drawing) of the second contact part C2 to the first magnet 140 (an up direction in the drawing), and for example, the arc may be cooled and extinguished by an extinguishing material such as air.

Here, the first contact part C1 may be disposed close to the second magnet 150, and the second contact part C2 may be disposed close to the first magnet 140. Therefore, the arcs which respectively occur in the contact parts C1 and C2 may receive a force in a direction deviating from each other due to the forces F12 and F22 at which the magnets 140 and 150 respectively attract the arcs. Also, when the electricity storage is charged, an action axis of the force F11' which is generated based on the Fleming's left hand rule and is applied and acts on the arc occurring in the first contact part C1 may be parallelly separated from an action axis of the force F21' which is generated based on the Fleming's left hand rule and is applied and acts on the arc occurring in the second contact part C2. Therefore, the arcs which respectively occur in the contact parts C1 and C2 are prevented from gathering at one position even when the electricity storage is charged.

The first contact part C1 may be disposed close to the second magnet 150 within a range where the first contact part C1 does not contact the second magnet 150, and the second contact part C2 may be disposed close to the first magnet 140 within a range where the second contact part C2 does not contact the first magnet 140. Therefore, the forces F12 and F22 at which the magnets 140 and 150 respectively attract the arcs, namely, a force which causes the arcs to deviate from each other, more increase. Also, a separation distance between the forces F11' and F12', which are generated based on the Fleming's left hand rule and respectively act on the arcs, more increases. Accordingly, when the electricity storage is charged, the arcs are more effectively prevented from gathering at one position.

Figure 8:
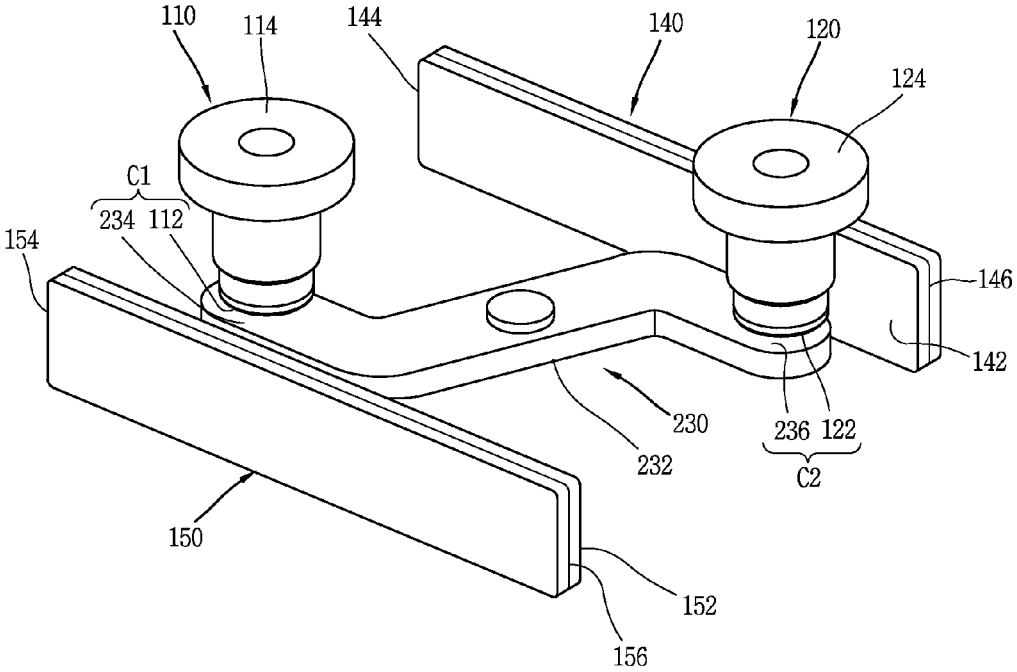
FIG. 8 is a perspective view illustrating a switching unit of a relay according to another exemplary embodiment of the present invention.
Figure 9:
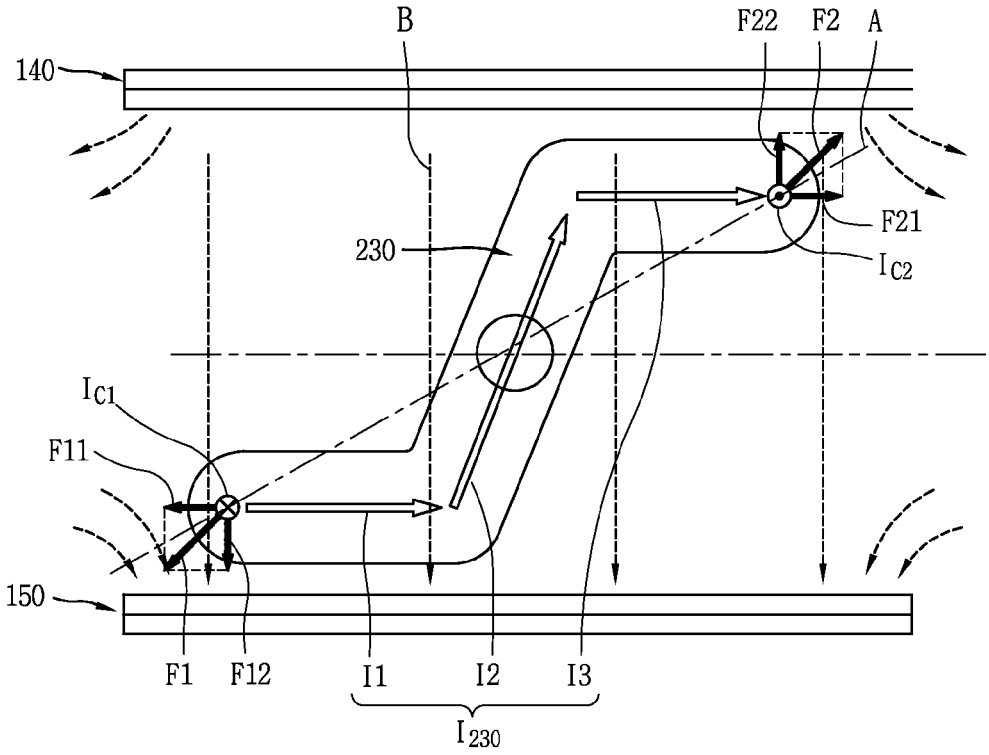
FIG. 9 is a plan view illustrating an extinguishment direction of an arc when the relay of FIG. 8 is discharged.
Figure 10:
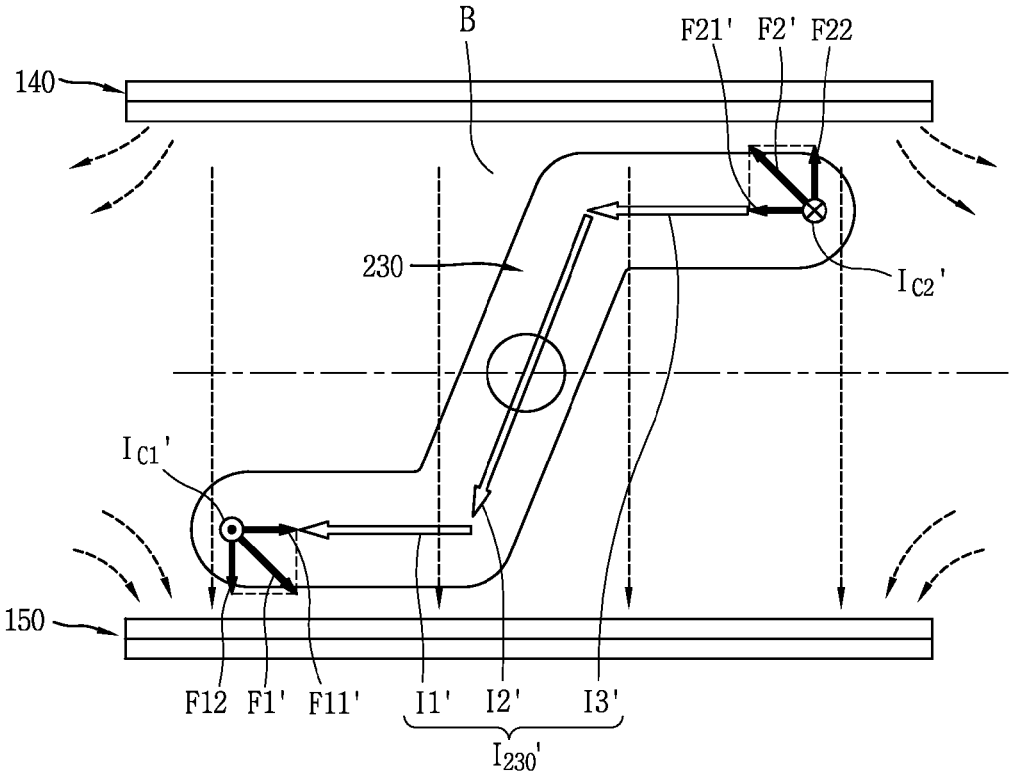
FIG. 10 is a plan view illustrating an extinguishment direction of an arc when the relay of FIG. 8 is charged.

FIG. 8 is a perspective view illustrating a switching unit of a relay according to another exemplary embodiment of the present invention. FIG. 9 is a plan view illustrating an extinguishment direction of an arc when the relay of FIG. 8 is discharged. FIG. 10 is a plan view illustrating an extinguishment direction of an arc when the relay of FIG. 8 is charged.

A fundamental configuration and an effect of the relay according to the present embodiment are approximately similar to the above-described embodiment. However, according to the present embodiment, in a movable contact 230, a first contact end 234 and a second contact end 236 (hereinafter referred to as contact ends) may be bent to be inclined with respect to a center 232, an extension direction of the center 232 may be inclined with respect to the polar surfaces 142 and 152, and extension directions of the contact ends 234 and 236 may be provided in parallel with the respective polar surfaces 142 and 152. Therefore, among currents $I_{230}$ and $I_{230}'$ flowing in the movable contact 230, currents I2 and I2' flowing in the center 232 may flow in a direction which is inclined with respect to a direction of a magnetic field B generated by each of the magnets 140 and 150. Accordingly, a magnitude of a force which is generated based on the Fleming's left hand rule and acts on the center 232 increases compared to the above-described embodiment but decreases compared to the related art. Thus, when an electricity storage illustrated in FIG. 9 is discharged, a contacting force between the movable contact 230 and the fixed contacts 110 and 120 is prevented from being reduced.

Figure 11:
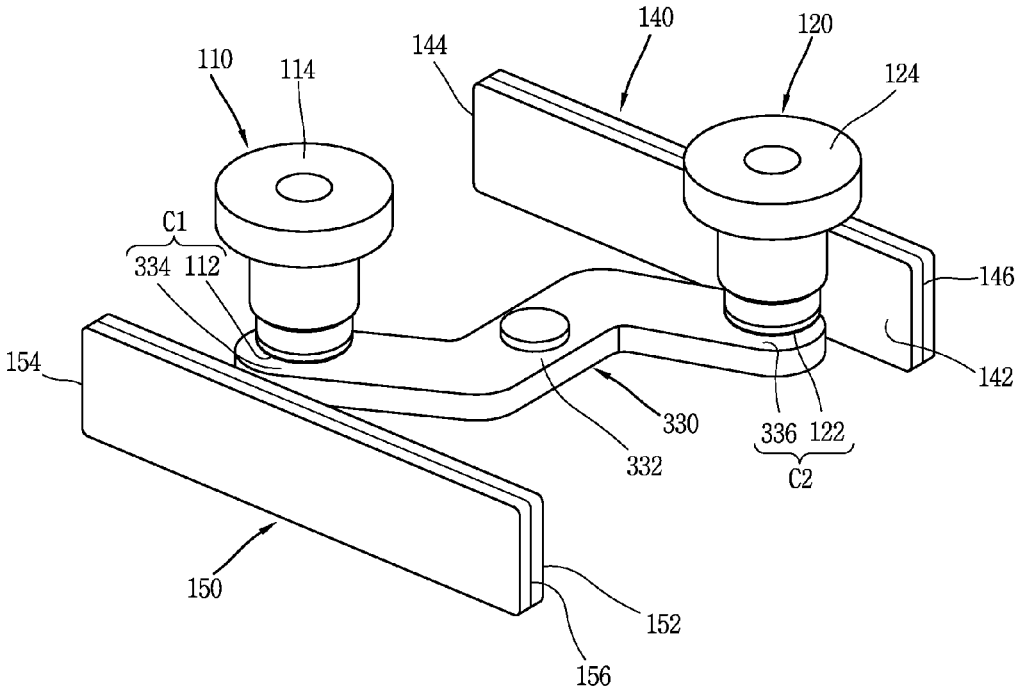
FIG. 11 is a perspective view illustrating a switching unit of a relay according to another exemplary embodiment of the present invention.
Figure 12:
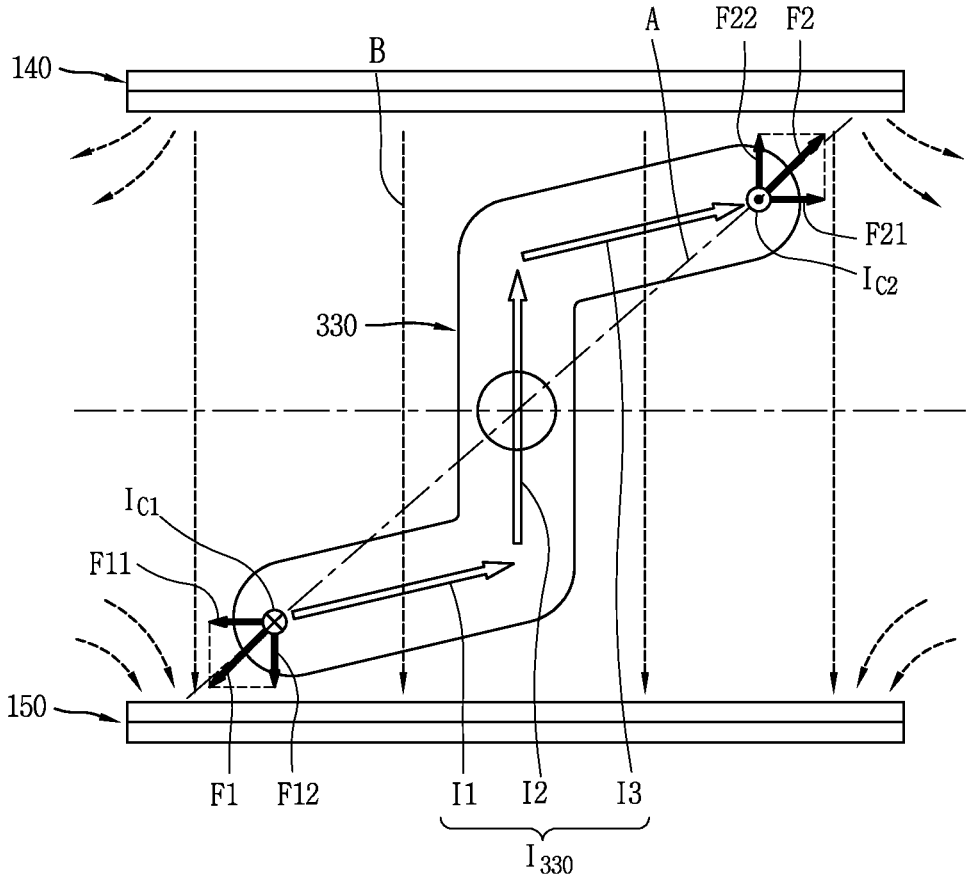
FIG. 12 is a plan view illustrating an extinguishment direction of an arc when the relay of FIG. 11 is discharged.
Figure 13:
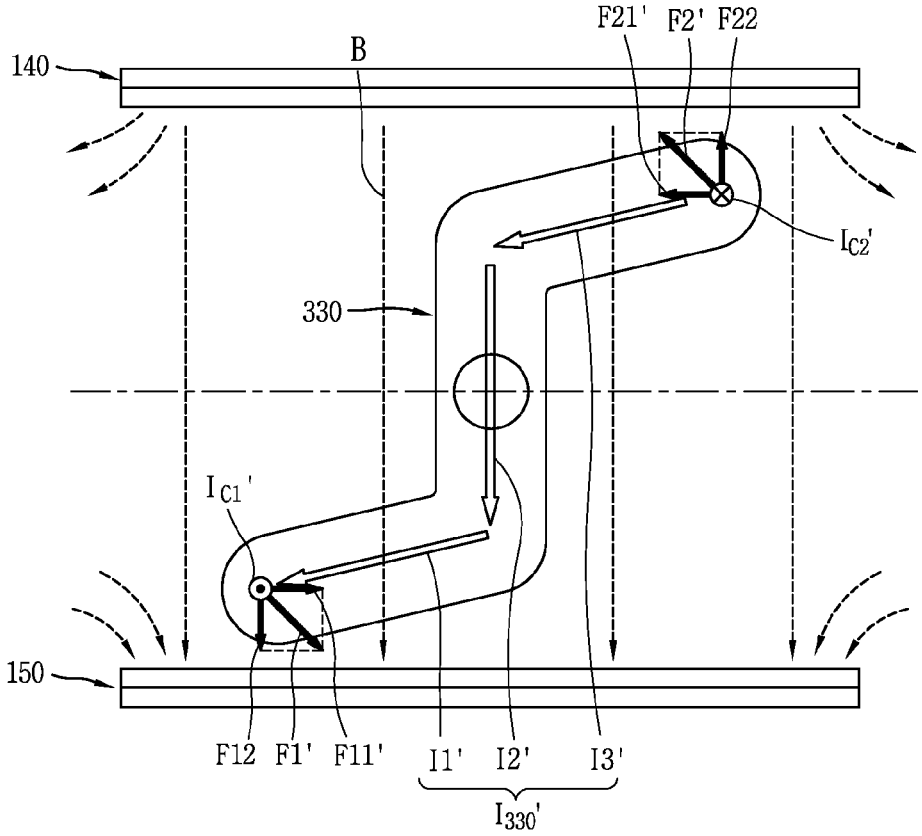
FIG. 13 is a plan view illustrating an extinguishment direction of an arc when the relay of FIG. 11 is charged.

FIG. 11 is a perspective view illustrating a switching unit of a relay according to another exemplary embodiment of the present invention. FIG. 12 is a plan view illustrating an extinguishment direction of an arc when the relay of FIG. 11 is discharged. FIG. 13 is a plan view illustrating an extinguishment direction of an arc when the relay of FIG. 11 is charged.

A fundamental configuration and an effect of the relay according to the present embodiment are approximately similar to the above-described embodiment. However, according to the present embodiment, in a movable contact 330, a first contact end 334 and a second contact end 336 (hereinafter referred to as contact ends) may be bent to be inclined with respect to a center 332, an extension direction of the center 332 may perpendicularly intersect the polar surfaces 142 and 152, and extension directions of the contact ends 334 and 336 may be provided to be inclined with respect to the respective polar surfaces 142 and 152. Therefore, among currents $I_{330}$ and $I_{330}'$ flowing in the movable contact 330, currents I2 and I2' flowing in the center 332 may flow in parallel with a direction of a magnetic field B generated by each of the magnets 140 and 150. Thus, a magnitude of a force which is generated based on the Fleming's left hand rule and acts on the center 332 may become zero. Furthermore, currents I1, I1', I2 and I2' which flow in the contact ends 334 and 336 may flow in a direction which is inclined with respect to the direction of the magnetic field B generated by each of the magnets 140 and 150. Accordingly, a magnitude of a force which is generated based on the Fleming's left hand rule and acts on the contact ends 334 and 336 is reduced compared to the above-described embodiment. Thus, when an electricity storage illustrated in FIG. 12 is discharged, a contacting force between the movable contact 330 and the fixed contacts 110 and 120 is more effectively prevented from being reduced than the above-described embodiment.

Figure 14:
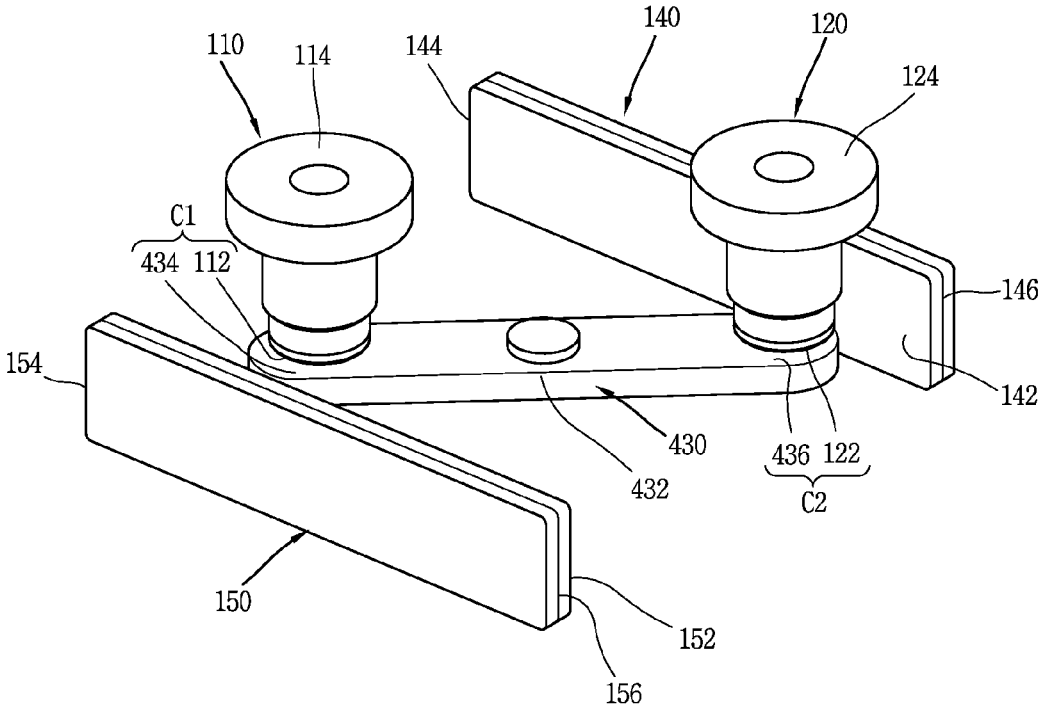
FIG. 14 is a perspective view illustrating a switching unit of a relay according to another exemplary embodiment of the present invention.
Figure 15:
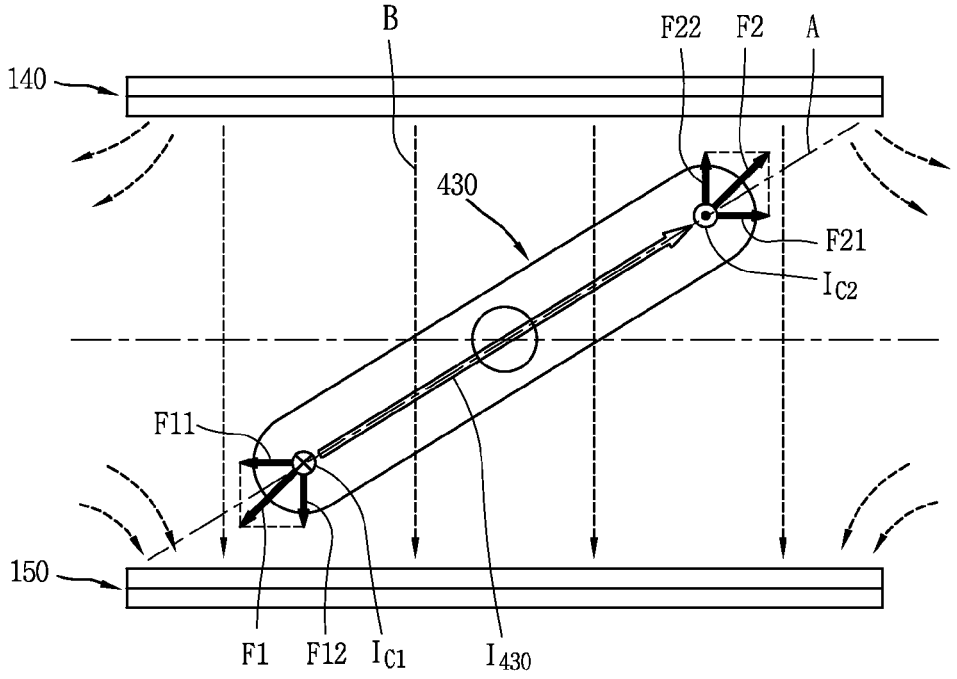
FIG. 15 is a plan view illustrating an extinguishment direction of an arc when the relay of FIG. 14 is discharged.
Figure 16:
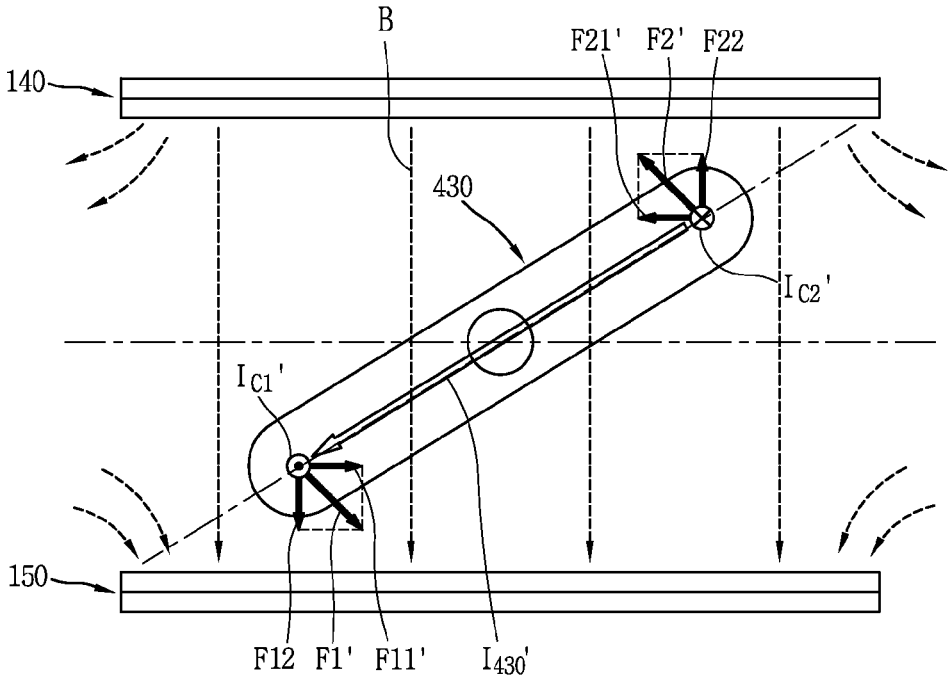
FIG. 16 is a plan view illustrating an extinguishment direction of an arc when the relay of FIG. 14 is charged.

FIG. 14 is a perspective view illustrating a switching unit of a relay according to another exemplary embodiment of the present invention. FIG. 15 is a plan view illustrating an extinguishment direction of an arc when the relay of FIG. 14 is discharged. FIG. 16 is a plan view illustrating an extinguishment direction of an arc when the relay of FIG. 14 is charged.

A fundamental configuration and an effect of the relay according to the present embodiment are approximately similar to the above-described embodiment. However, according to the present embodiment, a movable contact 430 may be long provided in a straight-line direction and may be inclined with respect to the polar surfaces 142 and 152. In other words, in the movable contact 430, a first contact end 434 and a second contact end 436 may not be bent with respect to a center 432, and extension directions of the center 423 and the contact ends 434 and 436 may be provided to be inclined with respect to the respective polar surfaces 142 and 152. Therefore, currents $I_{430}$ and $I_{430}'$ flowing in the movable contact 430 may flow in a direction which is inclined with respect to a direction of a magnetic field B generated by each of the magnets 140 and 150. Accordingly, a magnitude of a force which is generated based on the Fleming's left hand rule and acts on the movable contact 430 is reduced compared to the related art. Thus, when an electricity storage illustrated in FIG. 15 is discharged, a contacting force between the movable contact 430 and the fixed contacts 110 and 120 is prevented from being reduced.

Figure 17:
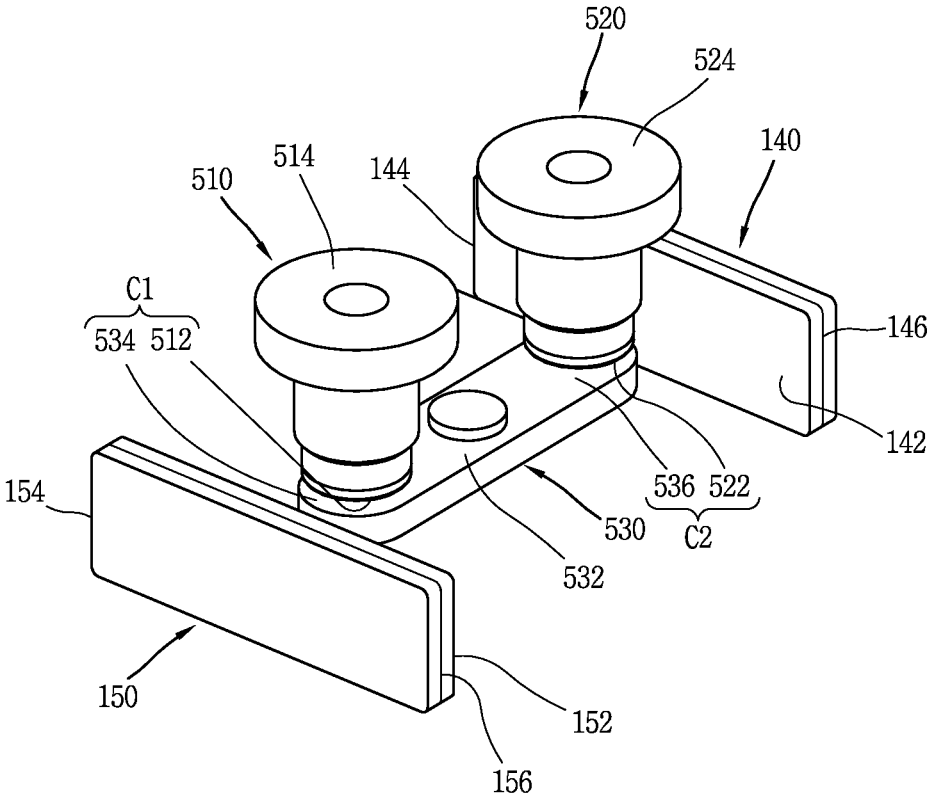
FIG. 17 is a perspective view illustrating a switching unit of a relay according to another exemplary embodiment of the present invention.
Figure 18:
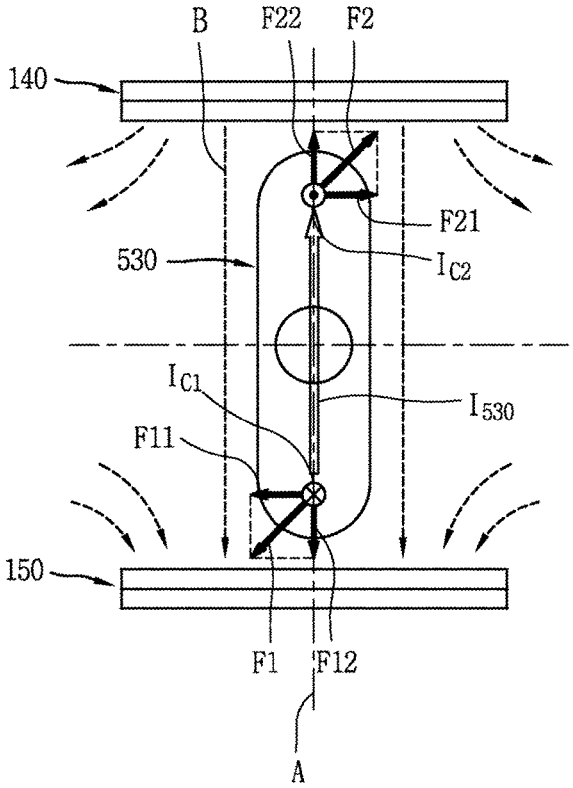
FIG. 18 is a plan view illustrating an extinguishment direction of an arc when the relay of FIG. 17 is discharged.
Figure 19:
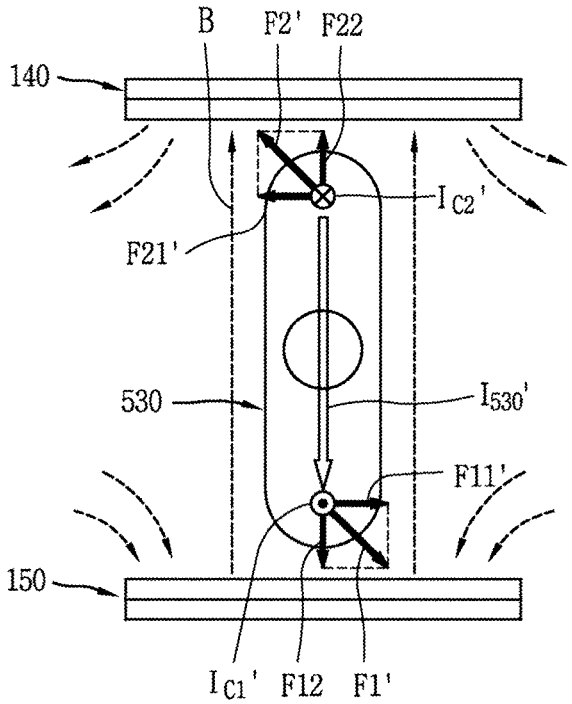
FIG. 19 is a plan view illustrating an extinguishment direction of an arc when the relay of FIG. 17 is charged.

FIG. 17 is a perspective view illustrating a switching unit of a relay according to another exemplary embodiment of the present invention. FIG. 18 is a plan view illustrating an extinguishment direction of an arc when the relay of FIG. 17 is discharged. FIG. 19 is a plan view illustrating an extinguishment direction of an arc when the relay of FIG. 17 is charged.

A fundamental configuration and an effect of the relay according to the present embodiment are approximately similar to the above-described embodiment. However, according to the present embodiment, a movable contact 530 may be long provided in a straight-line direction and may perpendicularly intersect the polar surfaces 142 and 152. In other words, in the movable contact 530, a first contact end 534 and a second contact end 536 may not be bent with respect to a center 532, and extension directions of the center 523 and the contact ends 534 and 536 may be provided to perpendicularly intersect the polar surfaces 142 and 152. Therefore, currents $I_{530}$ and $I_{530}'$ flowing in the movable contact 530 may flow in parallel with a direction of a magnetic field B generated by each of the magnets 140 and 150. Thus, a magnitude of a force which is generated based on the Fleming's left hand rule and acts on the movable contact 530 may become zero. Accordingly, when an electricity storage illustrated in FIG. 18 is discharged, a contacting force between the movable contact 530 and a plurality of fixed contacts 510 and 520 is more effectively prevented from being reduced than the above-described embodiment.

The foregoing embodiments and advantages are merely exemplary and are not to be considered as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds are therefore intended to be embraced by the appended claims.

What is claimed is:

1. A relay, comprising:

a first fixed contact;

a second fixed contact separated from the first fixed contact;

a movable contact configured to connect the first fixed contact to the second fixed contact and to detach the first fixed contact from the second fixed contact; and a first magnet including a first polar surface and a second magnet including a second polar surface, the first polar surface facing the second polar surface with a first contact part and a second contact part between the first polar surface and the second polar surface, wherein the first contact part causes the movable contact to contact and detach from the first fixed contact and the second contact part causes the movable contact to contact and detach from the second fixed contact, wherein the first contact part is located closer to the second magnet than to the first magnet, and wherein the second contact part is located closer to the first magnet than to the second magnet, and wherein the movable contact comprises:

a center portion extending parallel to and along a centerline that intersects the first magnet and the second magnet at approximately 90 ° such that a first end of the center portion extends toward the first magnet and a second end of the center portion extends toward the second magnet;

a first straight extending portion that extends away from the first end of the center portion at approximately 90 ° in a first direction such that the first extending portion extends parallel to the first magnet with a first contact end formed at an end of the first extending portion, the first contact end configured to detachably contact the first fixed contact; and a second straight extending portion that extends away from the second end of the center portion at approximately 90 ° in a second direction opposite to the first direction such that the second extending portion extends parallel to the second magnet with a second contact end formed at an end of the second extending portion, the second contact end configured to detachably contact the second fixed contact.

2. The relay of claim 1, wherein:

the first contact part is located close to the second magnet but does not contact the second magnet; and the second contact part is located close to the first magnet but does not contact the first magnet.

3. The relay of claim 1, wherein the first contact part and the second contact part are located on a virtual plane that perpendicularly intersects the first polar surface and the second polar surface.

4. The relay of claim 3, wherein:

the first contact end and the second contact end are bent such that they are vertical to the center portion of the movable contact; and the first fixed contact contacts the second fixed contact on the virtual plane such that an extension direction of the center portion of the movable contact is vertical to the first polar surface and the second polar surface, an extension direction of the first contact end is parallel to the first polar surface and the second polar surface, and an extension direction of the second contact end is parallel to the first polar surface and the second polar surface.

5. A relay, comprising:

a first fixed contact;

a second fixed contact separated from the first fixed contact;

a movable contact configured to connect the first fixed contact to the second fixed contact and to detach the first fixed contact from the second fixed contact; and a first magnet including a first polar surface and a second magnet including a second polar surface, the first polar surface facing the second polar surface with a first contact part and a second contact part between the first polar surface and the second polar surface, wherein the first contact part causes the movable contact to contact and detach from the first fixed contact and the second contact part causes the movable contact to contact and detach from the second fixed contact, wherein the first magnet and the second magnet are located such that they are not parallel to a virtual axis connecting the first contact part to the second contact part, and wherein the movable contact comprises:

a center portion extending parallel to and along a centerline that intersects the first magnet and the second magnet at approximately 90 ° such that a first end of the center portion extends toward the first magnet and a second end of the center portion extends toward the second magnet;

a first straight extending portion that extends away from the first end of the center portion at approximately 90 ° in a first direction such that the first extending portion extends parallel to the first magnet with a first contact end formed at an end of the first extending portion, the first contact end configured to detachably contact the first fixed contact; and a second straight extending portion that extends away from the second end of the center portion at approximately 90 ° in a second direction opposite to the first direction such that the second extending portion extends parallel to the second magnet with a second contact end formed at an end of the second extending portion, the second contact end configured to detachably contact the second fixed contact.

6. The relay of claim 5, wherein the first contact part and the second contact part are located on a virtual plane that perpendicularly intersects the first polar surface and the second polar surface.

7. The relay of claim 6 wherein:

the first contact end and the second contact end are bent such that they are vertical to the center portion of the movable contact; and the first fixed contact contacts the second fixed contact on the virtual plane such that an extension direction of the center portion of the movable contact is vertical to the first polar surface and the second polar surface, an extension direction of the first contact end is parallel to the first polar surface and the second polar surface, and an extension direction of the second contact end is parallel to the first polar surface and the second polar surface.

* * * * *